US007848843B2

(12) United States Patent
Shibata

(10) Patent No.: US 7,848,843 B2
(45) Date of Patent: Dec. 7, 2010

(54) EYEGLASS LENS PROCESSING APPARATUS AND LENS FIXING CUP

(75) Inventor: Ryoji Shibata, Toyokawa (JP)

(73) Assignee: Nidek Co., Ltd., Gamagori-Shi (JP)

( * ) Notice: Subject to any disclaimer, the term of this patent is extended or adjusted under 35 U.S.C. 154(b) by 324 days.

(21) Appl. No.: 12/050,398

(22) Filed: Mar. 18, 2008

(65) Prior Publication Data

US 2008/0248720 A1 Oct. 9, 2008

(30) Foreign Application Priority Data

Mar. 28, 2007 (JP) ..... 2007-086028
Mar. 28, 2007 (JP) ..... 2007-086029

(51) Int. Cl.
*G06F 19/00* (2006.01)
*B24B 49/00* (2006.01)

(52) U.S. Cl. ..... 700/164; 700/172; 700/173; 700/174; 700/175; 700/178; 700/180; 700/186; 700/191; 700/193; 451/5; 451/9; 451/11

(58) Field of Classification Search ..... 700/164, 700/170, 172–178, 180, 182, 186, 190, 191, 700/193; 451/1, 5, 9–12
See application file for complete search history.

(56) References Cited

U.S. PATENT DOCUMENTS 4,561,213 A 12/1985 Tusinski et al.
5,333,412 A 8/1994 Matsuyama
6,027,401 A * 2/2000 Saito et al. ..... 451/398
6,241,577 B1 6/2001 Shibata
6,283,826 B1 9/2001 Mizuno
6,790,124 B2 9/2004 Shibata
2001/0053659 A1 12/2001 Shibata
2002/0022436 A1 2/2002 Mizuno et al.
2006/0240747 A1 10/2006 Natsume et al.

FOREIGN PATENT DOCUMENTS

EP 0798076 A1 10/1997
EP 1510290 A1 3/2005
EP 1728590 A1 12/2006

(Continued)

OTHER PUBLICATIONS

Extended European Search Report dated Jul. 8, 2008.

*Primary Examiner*—Sean P Shechtman
(74) *Attorney, Agent, or Firm*—Sughrue Mion, PLLC

(57) ABSTRACT

In a two-step processing mode in which a cup for attaching a lens to a chuck axis is changed from a large diameter cup to a small diameter cup on the way of processing, a roughing path data computing unit for computing first roughing path data larger than the target lens shape data by a predetermined finishing margin, and second roughing path data having a radius vector larger by at least Δa than at least radius vector data of the large diameter cup; and a processing controller for roughing the peripheral edge of the lens based on the second roughing path data in response to a processing start signal, thereafter stopping the processing and further resuming the processing. The processing controller performs, when a processing resuming signal is inputted, processing control of either roughing and finishing, or finishing without roughing.

11 Claims, 10 Drawing Sheets

FOREIGN PATENT DOCUMENTS

| | | | |
|---|---|---|---|
| JP | 4-93164 | A | 3/1992 |
| JP | 10-249692 | A | 9/1998 |
| JP | 11-333684 | A | 12/1999 |
| JP | 2003-145328 | A | 5/2003 |
| JP | 2006-239782 | A | 9/2006 |
| JP | 2006-281367 | A | 10/2006 |

* cited by examiner

EYEGLASS LENS PROCESSING APPARATUS AND LENS FIXING CUP

BACKGROUND OF THE INVENTION

The present invention relates to an eyeglass lens processing apparatus for processing a peripheral edge of an eyeglass lens and a lens-fixing cup.

In processing the peripheral edge of an eyeglass lens, the peripheral edge of an eyeglass lens held by two lens chuck axes of the eyeglass lens processing apparatus is roughed by a roughing grindstone and thereafter finished by e.g. a finishing grindstone (see for example, U.S. Pat. No. 6,283,826 (JP-A-11-333684)). When the lens is held by the two lens chuck axes, first, a cup serving as a processing jig is fixed to the surface of the lens using a blocker. Thereafter, a base of the cup is mounted in a cup holder of the one lens chuck axis and the lens is held by a lens presser of the other lens chuck axis.

The lens during the processing undergoes load due to the reaction force and rotating force by the grinding stone. Considering this fact, in processing the lens with a large target lens shape, in order to ensure the holding force by chucking to the utmost, a large diameter cup with a large attaching area is adopted.

In recent years, the design of an eyeglass frame has been diversified and the processing of a lens with a narrow vertical width has been increased. In processing the lens with the target lens shape having a narrow vertical width, if an ordinary cup with a large diameter may interfere with a processing tool, a small diameter cup with a small vertical size of the plane to be attached to the lens is adopted (see, for example, U.S. Pat. No. 6,241,577 (JP-A-10-249692)).

However, in chucking, the small diameter cup provides a holding force smaller than that of the large diameter cup. Owing to this, particularly, in roughing the peripheral edge of a unprocessed lens with a large diameter, a rotary moment load applied to the lens chuck axes increases so that axis deviation is likely to occur. Further, in the case of the lens coated with a water-repellent substance in which water or oil is not prone to be deposited, this problem will become more conspicuous.

SUMMARY OF THE INVENTION

It is a technical problem of the invention to provide an eyeglass lens processing apparatus capable of reducing occurrence of axis deviation where the peripheral edge of a lens with a narrow vertical width or even in the lens which is likely to generate the axis deviation and permitting an easy operation.

In order to resolve the above-described fact, the invention provides the following structures.

(1) An eyeglass lens processing apparatus for processing a peripheral edge of an eyeglass lens based on target lens shape data, comprising:

a mode setting unit which shifts a processing mode to a two-step processing mode in which a cup for attaching the lens to a chuck axis is changed from a large diameter cup to a small diameter cup on the way of processing;

a roughing path data computing unit for computing first roughing path data larger than the target lens shape data by a predetermined finishing margin, and second roughing path data having a radius vector larger by at least Δa than at least radius vector data of the large diameter cup based on the first roughing path data and the radius vector data of the large diameter cup, Δa being a length set to avoid processing interference between a roughing tool and the large diameter cup; and a processing controller for roughing the peripheral edge of the lens attached to the large diameter cup based on the second roughing path data in response to a processing start signal, thereafter stopping the processing and further resuming the processing, wherein the processing controller performs, when a processing resuming signal is inputted, processing control of either finishing the peripheral edge using a finishing tool after roughing the peripheral edge of the lens replaced with the small diameter cup based on the first roughing path data using the roughing tool, or finishing the peripheral edge based on finishing path data using the finishing tool without roughing.

(2) The eyeglass lens processing apparatus according to (1), wherein the second roughing path data are corrected composition path data in which the first roughing path and the path of the radius vector data of the large diameter cup added with Δa are composed to provide an outermost composition path and an area where the first roughing path and the path of the radius vector data of the large diameter cup added with Δa intersect is further corrected to avoid the processing interference during the processing.

(3) The eyeglass lens processing apparatus according to (1), wherein the radius vector of the second roughing path data do not exceed a maximum distance determined based on rotation moment load applied to the lens during the processing with the small diameter cup.

(4) The eyeglass lens processing apparatus according to (1), wherein the second roughing path data are corrected composition path data in which the first roughing path and the path of the radius vector data of the large diameter cup added with Δa are composed in a shape not exceeding a maximum distance determined based on rotation moment load applied to the lens during the processing with the small diameter cup to provide an outermost composition path and an area where the first roughing path and the path of the radius vector data of the large diameter cup added with Δa intersect is corrected to avoid the processing interference during the processing.

(5) The eyeglass lens processing apparatus according to (4), wherein the maximum distance is 25 mm.

(6) The eyeglass lens processing apparatus according to (1) further comprising:

a determining unit for comparing stored radius vector data of the large diameter cup and simulated radius vector data after finishing to determine whether or not the processing interference occurs; and a display unit for displaying the determined result when the processing interference occurs.

(7) The eyeglass lens processing apparatus according to (1) further comprising a cup holder supporter corresponding to the size of the large diameter cup, the cup holder supporter being fit to a cup holder of the chuck axis and detachable therefrom.

(8) The eyeglass lens processing apparatus according to (1) further comprising a lens presser supporter corresponding to the size of the large diameter cup, the lens presser supporter being fit to a lens presser of the chuck axis and detachable therefrom.

(9) The eyeglass lens processing apparatus according to (1), wherein the cup includes:

a small diameter cup including a base mounted in a cup holder of the chuck axis and a small diameter flange attached to the base, one surface of the flange to be in contact with a surface of the lens through an adhesive material; and a supporter having an opening for inserting and removing the base of the small diameter cup, and including a surface to be in contact with the surface of the lens through an adhesive material having a larger diameter than that of the flange of the small diameter cup and a surface to be fit to the base side of the flange of the small diameter cup.

(10) The eyeglass lens processing apparatus according to (9), wherein the adhesive material is a double-faced tape having a cut separatable at a boundary between the flange of the small diameter cup and the supporter.

(11) The eyeglass lens processing apparatus according to (9), wherein the supporter is provided with hooks for removing the supporter from the small diameter cup.

(12) A lens fixing cup attached to a chuck axis in an eyeglass lens processing apparatus, comprising:

a small diameter cup including a base mounted in a cup holder of the chuck axis and a small diameter flange attached to the base, one surface of the flange to be in contact with a surface of a lens through an adhesive material; and a supporter having an opening for inserting and removing the base of the small diameter cup, and including a surface to be in contact with the surface of the lens through an adhesive material having a larger diameter than that of the flange of the small diameter cup and a surface to be fit to the base side of the flange of the small diameter cup.

(13) The lens fixing cup according to (12), wherein the adhesive material is a double-faced tape having a cut separatable at a boundary between the flange of the small diameter cup and the supporter.

(14) The lens fixing cup according to (12), wherein the supporter is provided with hooks for removing the supporter from the small diameter cup.

DETAILED DESCRIPTION OF PREFERRED EMBODIMENTS

Figure 1:
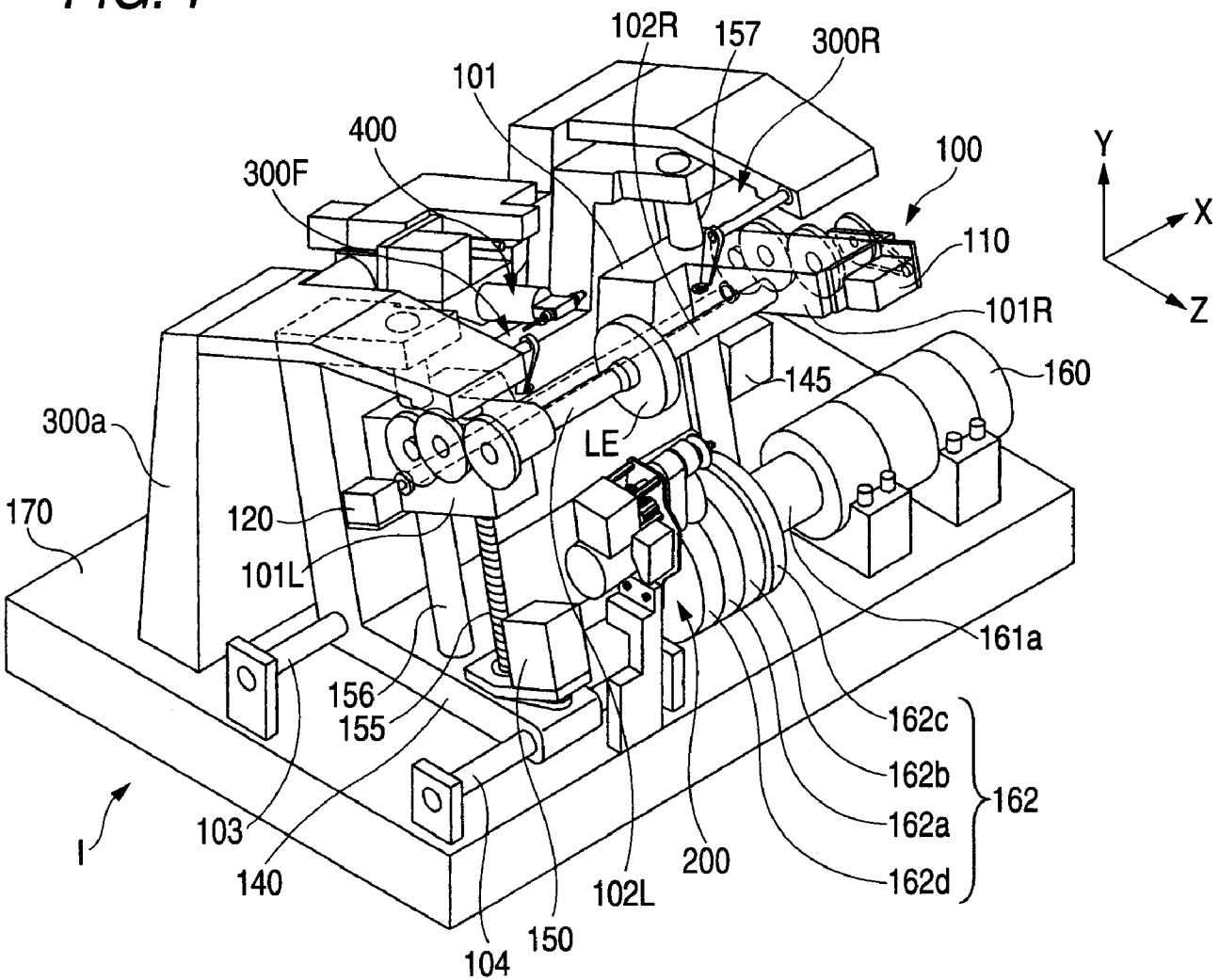
FIG. 1 is a schematic structure view of an eyeglass lens processing apparatus according to the present invention.

Now referring to the drawings, an embodiment of the invention will be explained as follows. FIG. 1 is a schematic structure view of a processing portion in an eyeglass lens peripheral edge processing apparatus according to the invention.

A carriage portion 100 including a carriage 101 and a moving mechanism thereof is mounted above a base 170. A lens LE to be processed is rotated by being held (pinched) by lens chucks 102L and 102R rotatably held by the carriage 101, and is processed by a grindstone 162 constituting a processing piece attached to a grindstone spindle 161 rotated by a grindstone rotating motor 160 fixed onto the base 170. The grindstone 162 of the embodiment includes a roughing grindstone (roughing tool) 162*a*, a bevel-finishing and flat-finishing grindstone (finishing tool) 162*b*, a bevel-polishing and flat-polishing grindstone (polishing tool) 162*c*, and a roughing grindstone (roughing tool) 162*d* for a glass lens. The grindstones 162*a* through 162*d* are coaxially attached to the grindstone spindle 161.

The lens chucks 102L and 102R are held by the carriage 101 such that center axes thereof (rotational center axis of lens EL) are in parallel with a center axis of the grindstone spindle (rotational axis of grindstone 162). The carriage 101 is movable in a direction of the center axis of the grindstone spindle 161 (direction of center axes of lens chucks 102L and 102R) (X axis direction), and movable in a direction orthogonal to the X axis direction (direction of changing distance between center axes of lens chucks 102L and 102R and center axis of grindstone spindle 161) (Y axis direction).

The lens chuck 102L is held by a left arm 101L of the carriage 101 and the lens chuck 102R is held by a right arm 101R of the carriage 101 rotatably and coaxially. The right arm 101R is fixed with a lens holding (pinching) motor 110 and the lens chuck 102R is moved in a direction of the center axis by rotating the motor 110. Thereby, the lens chuck 102R is moved in a direction of being proximate to the lens chuck 102L, and the lens LE is held (chucked) by the lens chucks 102L and 102R. Further, the left arm 101L is fixed with a lens rotating motor 120, the lens chucks 102L and 102R are rotated in synchronism with each other by rotating the motor 120 to rotate the lens LE held (pinched) thereby.

A moving support base 140 is movably supported by guide shafts 103 and 104 fixed in parallel above the base 170 and extended in the X axis direction. Further, an X axis direction moving motor 145 is fixed above the base 170, the support base 140 is moved in the X axis direction by rotating the motor 145, and the carriage supported by the guide shafts 156 and 157 fixed to the support base 140 is moved in the X axis direction.

The carriage 101 is movably supported by the guide shafts 156 and 157 fixed in parallel to the support base 140 and extended in the Y axis direction. Further, the support base 140 is fixed with a Y axis direction moving motor 150, and the carriage 101 is moved in the Y axis direction by rotating the motor 150.

Referring to FIG. 1, a chamfering mechanism 200 is arranged on this side of the apparatus body. The chamfering mechanism 200, which is well known, will not be explained here (see, for example, JP-A-2006-239782).

Figure 2:
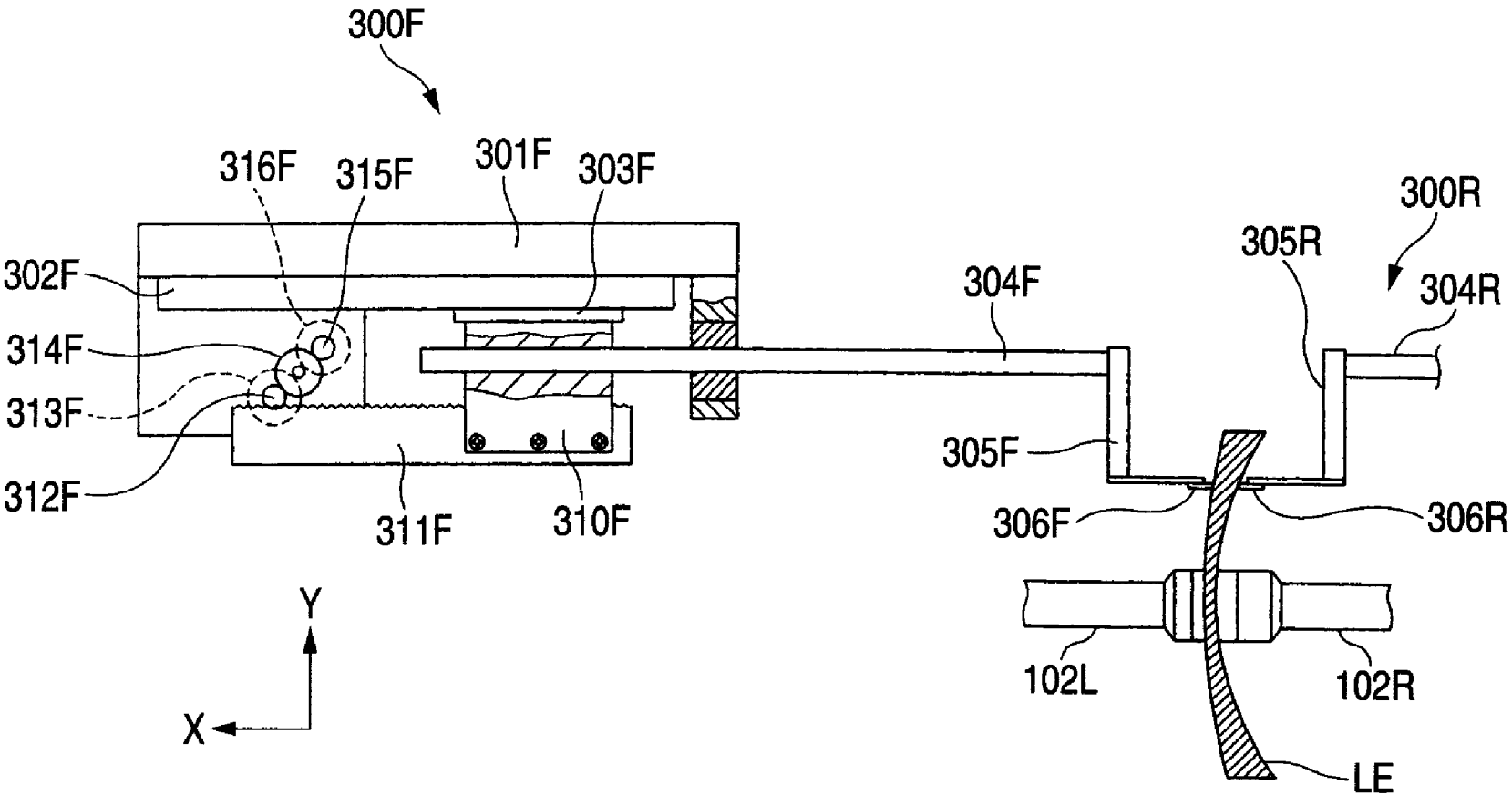
FIG. 2 is a schematic structure view of a lens edge position measuring unit.

Referring to FIG. 1, lens edge position measuring portions (lens surface position measuring portions) 300F and 300R are arranged above the carriage 101. FIG. 2 is a schematic structure view for measuring of the lens measuring portion 300F for measuring the lens edge position on the lens front surface. An attached support base 301F is fixed to a support base block 300*a* fixed on the base 170 in FIG. 1. A slider 303F is slidably attached on a rail 302F fixed on the attached support base 301F. A slide base 310F is attached to the slider 303F. A measuring piece arm 304F is fixed to the slide base 310F. An L-shape hand 305 is fixed to the tip of the measuring piece arm 304, and a measuring piece 306F is fixed to the tip of the hand 305. The measuring piece 306F is brought into contact with the front reflecting surface of the lens LE.

A lower end of the slide base 310F is fixed with a rack 311F. The rack 311F is brought in mesh with a pinion 312F of an encoder 313F fixed to the attached support base 301F. Rotation of the motor 316F is transmitted to the rack 311F by way of a gear 315F, an idle gear 314F and the pinion 312F, and slide base 310F is moved in the X axis direction. While the lens edge position is measured, the motor 316F presses the measuring piece 306F to the lens LE always by a constant force. The encoder 313F detects the moving position in the X-axis direction of the slide base 310F. The edge position (inclusive of the lens front surface position) on the front surface of the lens LE is measured using the information on the moving position, the information on the rotating angle of the axes of the lens chucks 102L and 102R and their moving information in the Y-axis direction.

The lens measuring portion 300R for measuring the edge position of a rear surface of the lens LE is symmetrical with the lens measuring portion 300F in a left and right direction, and therefore, with "R" substituted for "F" at the ends of the symbols appended to the respective constituent elements of the measuring portion 300F in FIG. 2, an explanation of the structure thereof will be omitted.

The lens edge position will be measured in such a manner that the measuring piece 306F is brought into contact with the front surface of the lens and the measuring piece 306R is brought into contact with the rear surface of the lens. In this state, the carriage 101 is moved in the Y axis direction based on a target lens shape data, and the lens LE is rotated to thereby simultaneously measure edge data of the front surface of the lens and the rear surface of the lens for processing the lens peripheral edge.

Referring to FIG. 1, a hole processing and grooving mechanism 400 is arranged on a rear side of the carriage portion 100. The structure of the carriage portion 100, the lens edge position measuring portion 300F and 300R and the hole processing and grooving mechanism 400, which may be those described in U.S. Pat. No. 6,790,124 (JP-A-2003-145328), will not be explained in detail.

Figure 3:
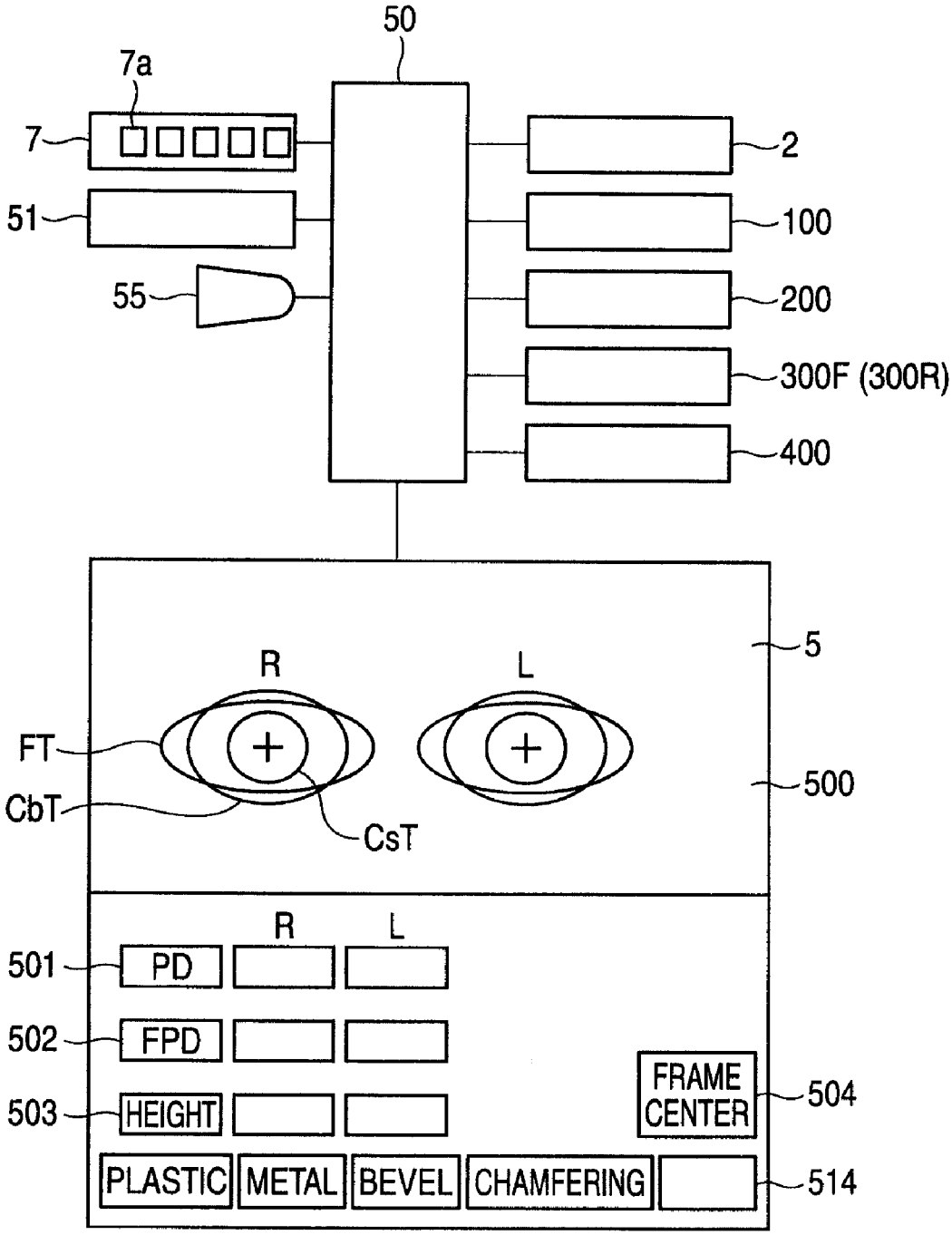
FIG. 3 is a control block diagram of an eyeglass lens processing apparatus.

FIG. 3 is a control block diagram of the eyeglass lens peripheral edge processing apparatus. A control unit 50 is connected with an eyeglass frame shape measuring unit 2 (which may be that described in U.S. Pat. No. 533,412 (JP-A-4-93164)), a display 5 serving as a touch panel type of a display unit and an input unit, a switch unit 7, a memory 51, a sound generator 55, the carriage portion 100, the chamfering mechanism 200, the lens edge position measuring portions 300F, 300R, the hole processing and grooving mechanism 400 and others. An input signal to the apparatus can be inputted by touching the display on the display 5 with a touch pen (or a finger). The control unit 50 receives the input signal by the touch panel function of the display 5 to control the display of the graphic and information of the display 5. The switch unit 7 is provided with start switch 7*a* for inputting a processing start signal to start lens peripheral edge processing.

Figure 4A:
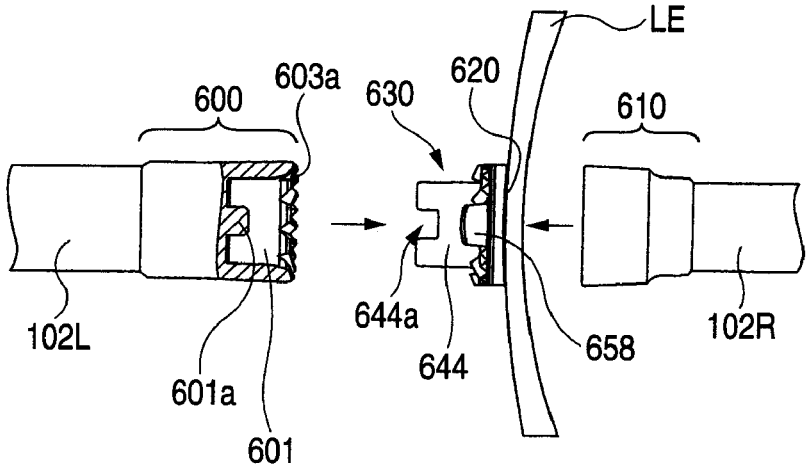
FIGS. 4A to 4B are views for explaining a cup holder and a lens presser.
Figure 4B:
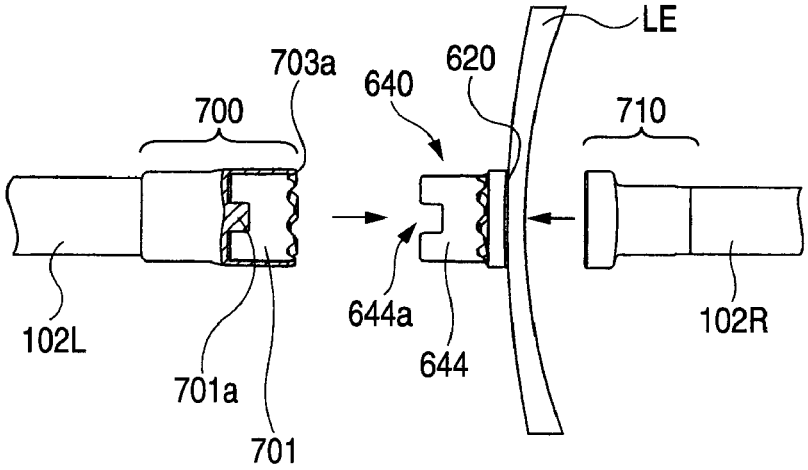

Next, an explanation will be given of the structure in which the lens LE is held by the chuck axes (lens rotating axes) 102L, 102R. FIGS. 4A and 4B are views showing the structure of a cup holder and a lens presser for holding the lens LE by the lens chuck axes 102L, 102R. FIG. 4A is a view of the lens holder and lens presser in the case where a large diameter cup 730 shown in FIG. 6 or another large diameter cup 630 described later is employed. To the tip of the lens chuck axis 102L, the cup holder 600 is detachably attached by set screws. To the tip of the lens chuck axis 102R, the lens presser 610 is detachably attached by set screws. Further, to the front surface of the lens LE, the large diameter cup 630 is fixed through a double-faced adhesive tape 620. The attaching structure of the cup holder 600 to the lens chuck axis 102L and the attaching structure of the lens presser 610 to the lens chuck axis 102, which are well known, will not be explained here.

FIG. 4B is a view of a lens holder 700 and a lens presser 710 in the case where a small diameter cup 640 described later is employed. The cup holder 700, in place of the cup holder 600, is detachably attached to the lens chuck axis 102L by set screws. The cup presser 710, in place of the lens presser 610, is also detachably attached to the lens chuck axis 102R by set screws. The cup holder 700 and lens presser 710 have smaller diameters than those of the cup holder 600 and lens presser 610 in FIG. 4A and formed with a size nearly equal to the outer diameter of the small diameter cup 640 (peripheral edge of a flange 642 shown in FIG. 5B), respectively. Therefore, even the lens with a narrow vertical width can be processed with no processing interference with the grinding stone to the vicinity of the minimum size of the small diameter cup 640.

Figure 5A:
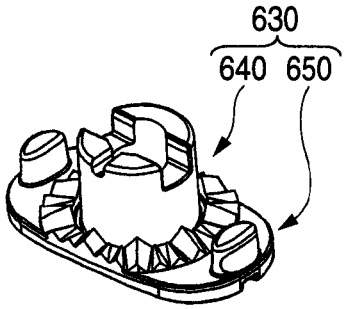
FIGS. 5A to 5C are views for explaining a small diameter cup, a supporter and others.
Figure 5B:
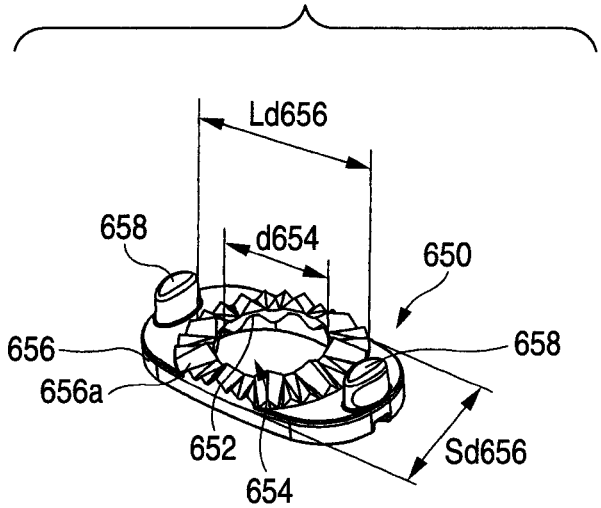
Figure 5B:
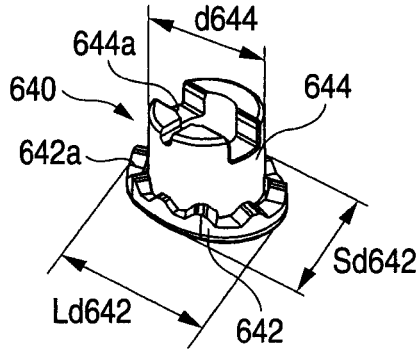
Figure 5C:
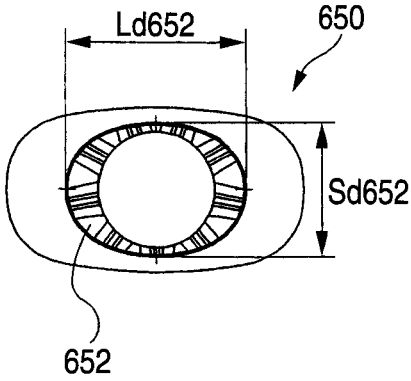
Figure 5C:
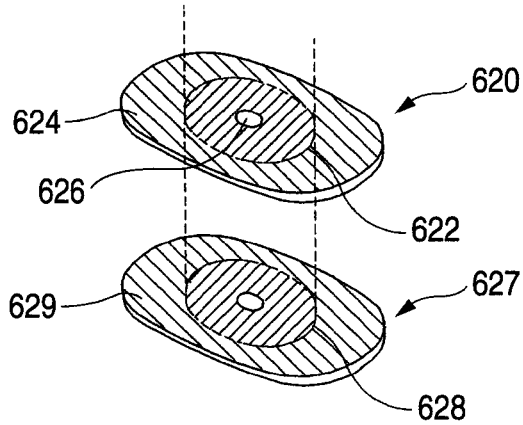

Referring to FIGS. 5A to 5C, the structure of the cup 630 will be explained. The cup 630 has a double structure consisting of the small diameter cup 640 employed when the lens with a small vertical size is processed and a supporter 650 put thereon. The cup 630 is used as a large diameter cup when the small diameter cup 640 and supporter 650 are integrated by their combination. FIG. 5A is a view showing the state in which the small diameter cup 640 and the supporter 650 are integrated. FIG. 5B is a view showing state in which the small diameter cup 640 and the supporter 650 are separated from each other. FIG. 5C is a view when the supporter 650 is seen from the bottom.

The small diameter cup 640 integrally includes a base 644 to be inserted in an insertion hole 601 of the cup holder 600 attached to the lens chuck axis 102L and a small diameter flange 642 extended around the bottom of the base 644 (lens fixed side). The lower surface of the flange 642 is employed as a plane to be fixed to the lens. The base 644 has a key groove 644*a*. By fitting the key groove 644*a* to a key 601*a* formed in the insertion hole 601, the lens LE can be attached to the lens chuck axis 102L with the axial angle (astigmatism axial angle) of the lens LE being a constant relationship therewith. The insertion hole 701 and key 701*a* of the cup holder 700 for the small diameter cup are formed with the same sizes as those of the insertion hole 601 and key 601*a* of the cup holder 600. So, also when the small diameter cup 640 is employed solely, the lens LE can be similarly attached to the lens chuck axis 102L.

The flange 642 of the small diameter cup 640 is elliptic. In order that the plane of the flange 642 to be fixed to the lens LE can deal with the lens having a small vertical width to the utmost, the short axis Sd642 of the flange 642 is 15 mm or less which is larger than the diameter (now 11 mm) of the base 644. In this embodiment, the short axis Sd642 is 13.5 mm. The long axis Ld642 of the flange 642 may have the size equal to that of the short axis Sd642, but is set at 18 mm longer than it so as to ensure the holding force when the small diameter cup 640 is attached to the cup holder 700 for the small diameter cup. At the upper part of the flange 642, an uneven area 642*a* is formed. The uneven area 642*a* meshes with an uneven area 703*a* formed at the tip of the cup holder 700 when the base 644 is inserted into the insertion hole 701.

The flange 656 of the supporter 650 is elliptic. An opening 654 is formed at its center. The inner diameter d654 of the opening 654 is nearly equal to the outer diameter d644 of the base 644 of the small diameter cup 640 (about 11 mm) so that the base 644 is inserted into the opening 654. A fitting hole 652 is formed at the bottom of the supporter 650. The fitting hole 652 has an uneven shape meshing with the uneven area 642*a* of the flange 642 of the small diameter cup 640. In the fitting hole 652, the flange 642 is fit with a predetermined relationship therewith. The long axis Ld652 of the fitting hole 652 is nearly equal to the long axis Ld 642 of the flange 642. The short axis Sd652 of the fitting hole 652 is equal to the short axis Sd642 of the flange 642. By putting the supporter 650 from above on the small diameter cup 640 through the opening 654 so that the flange 642 is fit in the fitting hole 652, the supporter 650 can be integrated to the small diameter cup 640 in a predetermined relationship therebetween. The depth of the fitting hole 652 is designed so that when the small diameter cup 640 is fit to the supporter 650, the bottom of the supporter 650 is nearly flush with the bottom of the small diameter cup 640. Thus, the small diameter cup 640 integrated with the supporter 650 can be attached to the surface of the lens LE as the large diameter cup 630. If only the supporter 650 is removed, the small diameter cup 640 fixed to the lens LE can be left on the lens.

Further, referring to FIG. 5B, an uneven area 656*a* is formed on the periphery of the opening 654 in the upper surface of the flange 656. When the base 644 is inserted in the insertion hole 601 of the cup holder 600, the uneven area 603*a* formed at the tip of the cup holder 600 is fit in mesh to the uneven area 656*a* of the flange 656. The outer periphery of the uneven area 656*a* has an elliptical shape with a long axis in the lateral direction. Its long axis Ld656 has a length of 20 mm and its short axis Sd656 has a length of 17 mm. The dimension of these Ld656 and Sd656 are the same as those of the outer periphery of an uneven area 756*a* of an integral type large diameter cup 730 shown in FIG. 6 so that in roughing the peripheral edge of the lens LE, the axis deviation can be suppressed.

Further, referring to FIG. 5B, two hooks 658 are formed on the upper surface of the flange 656 at the positions apart from the outer periphery of the uneven area 656*a* (i.e., positions where no interference with the cup holder 600 occurs when mounted in the cup holder 600). These hooks 658 are used to be hooked by a cup removing jig (not shown) when the supporter 650 is removed after the processing using the cup 630. By using the hooks 658, only the supporter 650 attached to the lens LE can be easily removed.

The cup 630 in which the small diameter cup 640 is integrated with the supporter 650 is attached to the surface of the lens LE through the double-faced adhesive tape 620 using a well known blocker. The outer shape of the double-faced adhesive tape 620 has a size nearly equal to that of the peripheral edge of the supporter 650. When the outer periphery of the tape 620 is merged with the peripheral edge of the supporter 650 by bonding, a break 622 is formed at the position which nearly coincides with the outer periphery of the flange 642 of the small diameter cup 640. So, when only the supporter 650 is removed from the lens LE with the cup 630 attached thereto, because of the presence of the break 622, an outer region 624 of the tape 620 can be easily removed together with the supporter 650. Incidentally, if the lens LE is a minus lens, its vicinity of the center is thin and brittle. So, in order to reduce the load applied to the vicinity of the center of the lens LE, a hole 626 having a diameter of 5 mm is formed at the center of the tape 620.

Where the surface of the lens LE is subjected to water-repellant coating and slippery so that the double-faced adhesive tape 620 is difficult to directly bond onto the surface of the lens LE, bonding a patch seal 627 to the surface of the lens LE facilitates bonding of the tape 620. The patch seal 627 also has the same outer peripheral edge as the tape 620 and a break 628 at the same position as in the tape 620. Thus, when the supporter 650 is removed, a region 629 outside the break 628 can be easily removed together with the region 624 of the tape 620 and supporter 650.

Referring to FIG. 4A, the peripheral edge shape of the cup holder 600 when the cup 630 is used is designed to nearly coincide with the outer peripheral shape of the uneven area 656*a* formed at the flange 656 of the supporter 650. The peripheral edge shape of the lens presser 610 is also designed to nearly coincide with the peripheral edge shape of the cup holder 600. If the peripheral edge shapes of the lens presser 610 and the cup holder 600 are greatly different from each other, shearing stress will be generated in the direction of the lens chuck axes 102L, 102R so that cracks in the coating or lens LE may be generated. In order to obviate such an inconvenience, it is preferred that the peripheral edge shapes of the lens presser 610 and the cup holder 600 nearly coincide with each other. The cup 630 mounted in the cup holder 600, which has a wider plane fixed to the lens LE than that of the small diameter cup 640, is strongly held by the lens chuck axes 102L, 102R through the cup holder 600 and lens presser 610.

Figure 6:
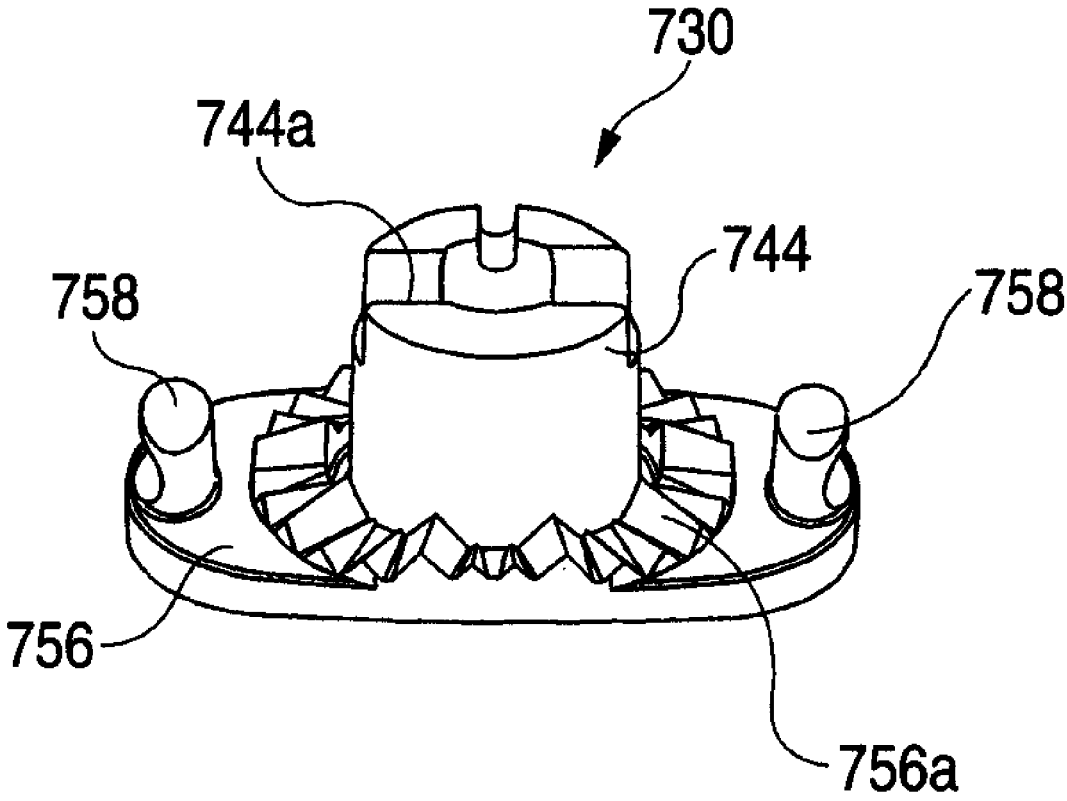
FIG. 6 is a view for explaining an integral type large diameter cup.

FIG. 6 is a view for explaining an integral type large diameter cup 730, which has been conventionally employed. The shape of the integral type large diameter cup 730 is the same as that of the cup 630 composed of the small diameter cup 640 and the supporter 650 put thereon. The flange 756, uneven area 756*a*, hooks 758, base 744 and key groove 744*a* of the large diameter cup 730, which are the same as the flange 656, uneven area 656*a*, hooks 658, base 644 and key groove 644*a* of the cup 630, respectively, will not be explained here.

Next, an explanation will be given of the processing operation of the lens peripheral edge by the apparatus having the structure described above. The target lens shape data (rn, θn) (n=1, 2, . . . N) of the eyeglass frame measured by the eyeglass frame shape measuring unit 2 are inputted by depressing the switches of the switch unit 7 and stored in the memory 51. In the target lens shape data, rn represents a radius vector length and θn represents a radius vector angle. When the target lens shape data are inputted, the target lens shape diagram FT based on the target lens shape data is displayed on the screen 500 of the display 5. The data of the peripheral edge shape of the large diameter cup 630 (large diameter cup 730 also) and of the peripheral edge shape (outer diameter shape) of the small diameter cup 640 are previously stored in the memory 51. On the screen 500 of the display 5, a cup diagram CsT indicative of the outer diameter of the small diameter cup 640 and a cup diagram CbT indicative of the outer diameter of the large diameter cup 630 are displayed to be superposed on the target lens shape diagram FT.

By depressing a button key 501, a numerical key pad (not shown) appears thereby to provide a state where the PD (pupillary distance) value of a wearer can be inputted. Similarly, by depressing a button key 502, a state is provided where the FPD (frame pupillary distance) value of the eyeglass frame can be inputted; and by depressing a button key 503, a state is provided where the layout data such as the height of an optical center relative to the geometric center of the target lens shape can be inputted. Further, by depressing a button key 504, an optical center mode of attaching the cup at the optical center of the lens or a frame center mode of attaching the cup at the geometric center of the target lens shape can be set. Setting the optical center mode and the frame center mode provides the position data of the attaching center (lens rotating center) of the cup relative to the target lens shape. Where the lens having a narrow vertical width is to be processed, the frame center mode is selected.

Further, the processing conditions such as the material of the lens, kind of the frame, processing mode (bevel-processing, flat processing and grooving processing) and presence or absence of chamfering can be set by manipulating predetermined button keys displayed on the display 5. Where the vertical width of the target lens shape (lens after the finishing) is smaller than the outer diameter of the large diameter cup 630, a cup changing processing mode can be set by a switch 514. In the cup changing processing mode, after the roughing is carried out using the large diameter cup 630, the large diameter cup 630 is replaced by the small diameter cup 640 to carry out the finishing.

Incidentally, whether or not the cup changing processing mode should be set may be decided by the control unit 50. Based on the target lens shape data, layout data of the cup center relative to the target lens shape (which is determined by setting the frame center mode or optical center mode) and the outer diameter data of the large diameter cup 630 stored in the memory 51, the control unit 50 computes whether or not the outer diameter of the large diameter cup 630 extends off the target lens shape to generate processing interference. Where the processing interference is generated, this fact will be displayed on the display 5. Further, based on the positional relationship between the target lens shape FT and the cup diagram CbT displayed on the screen of the display 5, it can be decided whether or not an operator should set the cup changing processing mode.

An explanation will be given of a normal processing operation in which the outer diameter of the large diameter cup 630 does not protrude from the target lens shape and so no processing interference is generated. After the data necessary for the processing is inputted, the operator chucks the lens LE with the large diameter cup 630 or 730 by the cup holder 600 of the lens chuck axis 102L and lens presser 610 of the lens chuck axis 102R and depresses the start switch 7*a* of the switch unit 7 to actuate the apparatus. The control unit 50 operates the measuring portions 300F, 300R in response to the start signal and measures the edge positions on the front surface and rear surface of the lens LE based on the target lens shape data. In the case of the bevel processing mode, for example, at two points of a bevel apex and bevel bottom in the same longitudinal direction, the edge positions are measured. After the edge positions on the lens front surface and the lens rear surface have been acquired, according to a predetermined program, the control unit 50 acquires, as a finishing path, the bevel path data to be formed on the lens LE based on the target lens shape data and edge position information. In the bevel path data, the bevel apexes are arranged on the entire radius vector so as to divide the edge thickness at a predetermined ratio. Further, the control unit 50 acquires, as roughing path data, the path increased from the finishing path by a predetermined finishing margin (e.g. 1 mm) in the radius vector direction.

Based on the roughing path data, the control unit 50 controls the movement of the carriage 101 and rotation of the lens LE to rough the peripheral edge of the lens LE held by the lens chuck axes 102L and 102R using the roughing grindstone 162*a*. Subsequently, based on the bevel path data, the control unit 50 controls the movement of the carriage 101 on the bevel path data to bevel-finish the peripheral edge of the lens LE using the finishing grindstone 162*b*.

Next, an explanation will be given of the case where the cup changing processing mode is set. The cup 630 is set in advance on the surface of a unprocessed lens LE by a well known blocker. The operator mounts the lens LE with the cup 630 in the cup holder 600 of the lens chuck axis 102L and chucks it by the lens chuck axis 102R with the lens presser 610 and depresses the start switch 7*a* of the switch unit 7 to actuate the apparatus.

After the processing start signal is inputted, prior to roughing, in order to confirm whether or not the diameter of the unprocessed lens LE suffices the processing dimension of the peripheral edge of the lens, the control unit 50 actuates the measuring portions 300F, 300R based on the target lens shape data to measure the edge positions on the front surface and rear surface of the lens LE. The measured path at this time may be measured based on the target lens shape data within a range where the interference of the measuring pieces 306F, 306R with the large diameter cup 630 is avoided, or otherwise may be a roughing path described later. The range in which the interference of the measuring pieces 306F, 306R with the large diameter cup 630 is avoided is computed by the control unit 50 based on the target lens shape data, the layout data (determined by the frame center mode or optical center mode) of the cup center relative thereto and the outer diameter data of the large diameter cup 630 stored in the memory 51. Further, in order to shorten the measuring time at this time, the position of the radius vector length of the target lens shape data farthest from the optical center of the lens has only to be measured. The radius vector length data of the target lens shape data relative to the optical center of the lens can be acquired from the layout data consisting of the PD, FPD and the height data at the optical center of the target lens shape relative to the geographical center thereof. Incidentally, if the geographical center of the target lens shape is different from the lens rotating center, the target lens shape data are used as the shape data converted with reference to the lens rotating center.

If the lens diameter is short as a result of the measurement of the lens edge positions, this fact is displayed on the display 5 as a warning message. If the lens diameter is sufficient, subsequently, the control unit 50 computes the roughing path data to rough the peripheral edge of the unprocessed lens using a roughing tool.

Figure 7A:
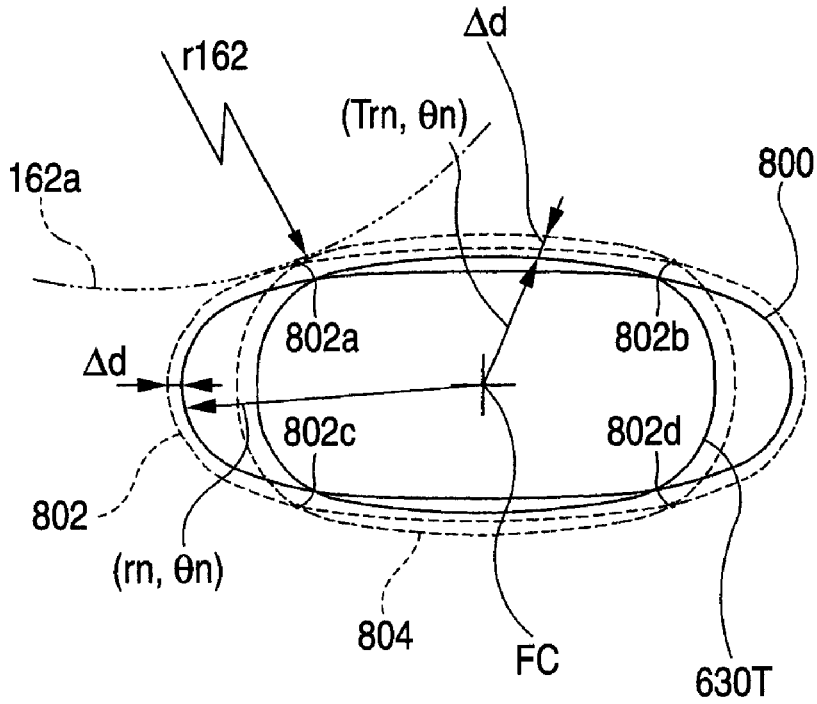
FIGS. 7A to 7B are views for calculation of roughing path data.
Figure 7B:
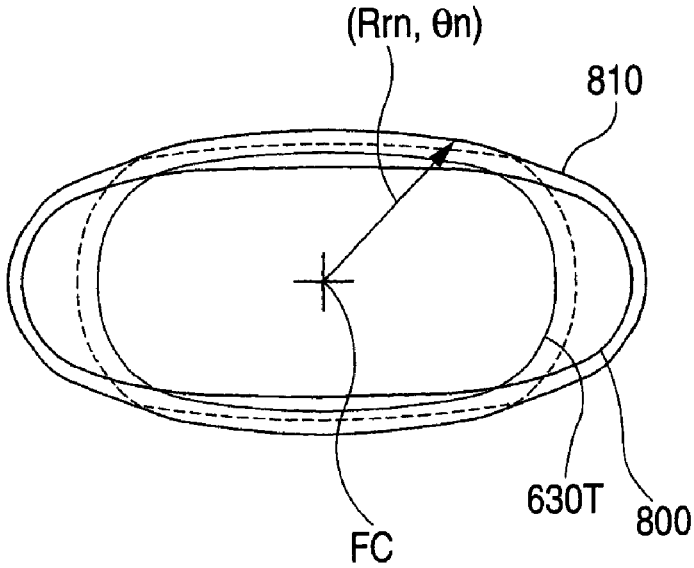

Referring to FIGS. 7A to 7B, an explanation will be given of computing the roughing path data. In FIG. 7A, reference numeral 800 denotes the target lens shape and reference numeral 630T denotes the outer diameter (cup outer diameter) of the large diameter cup 630. The center (lens rotating center) of the outer diameter 630T is caused to agree with the geometrical center FC of the target lens shape 800. The target lens shape 800 is the finishing path of the target lens shape. The first path 802 of the radius vector ($rn+\Delta d$, $\theta n$) ($n=1, 2, \ldots, N$) increased from the radius vector data ($rn$, $\theta n$) of the target lens shape 800 by a predetermined processing margin $\Delta d$ in the radius vector direction with reference to the center FC is set. In order to avoid the interference of the roughing grindstone 162*a* with the cup 630 attached to protrude from the target lens shape 800, the second path 804 of the radius vector data ($Trn+\Delta d$, $\theta n$) ($n=1, 2, \ldots, N$) increased from the radius vector data ($Trn$, $\theta n$) ($n=1, 2, \ldots, N$) of the radius vector data of the cup outer diameter 630T by a predetermined distance $\Delta d$ in the radius vector direction with reference to the center FC is set. As the roughing path, the outermost path composed of the first path 802 and the second path 804 is adopted. However, when the spots 802*a*, 802*b*, 802*c* and 802*d* where the first path 802 and the second path 804 intersect are attempted to be processed by the roughing grinding stone 162*a* having a radius r162, the grindstone 162*a* exceeds the first path 802 and second path 804 around them to interfere with the cup 630. In order to avoid this, as shown in FIG. 7B, a path 810 of the radius vector ($Rrn$, $\theta n$) ($n=1, 2, \ldots, N$) drawn so that the roughing grindstone 162 having a radius of r162 is in contact with the outermost path composed of the first path 802 and the second path 804 is computed as roughing path data.

The control unit 50 controls the movement of the carriage 101 and the rotation of the lens LE based on the roughing path data thus computed to rough the lens peripheral edge using the roughing grindstone 162*a*. During the roughing, the lens peripheral edge far from the chucking center of the lens undergoes relatively large rotation moment load owing to the rotation of the lens and the rotating force of the roughing grindstone 162*a*. However, since the lens LE is held by the lens chucking axes 102L and 102R through the cup 630 having a large diameter, its holding force is ensured. Thus, the axis deviation by the roughing stone 162*a* during the roughing can be suppressed.

Upon completion of the roughing, the control unit 50 once stops the processing of the lens peripheral edge and informs an operator of completion of the roughing by the screen 500 and sound generator 55. When the operator depresses the switch of the switch unit 7, the lens chuck axis 102R is opened so that the lens LE is released from the chucked state. The operator takes out the lens LE with the cup 630 and using a cup peeling jig (not shown), removes, from the cup 630, the supporter 650, the outer region 624 of the double-faced adhesive tape and outer region 629 of the patch seal. This provides a state where only the small diameter cup 640 is fixed to the lens LE.

Further, the operator changes the cup holder 600 mounted in the lens chuck axis 102L into the cup holder 700 and changes the lens holder 610 mounted in the chuck axis 102R into the lens holder 710. Thereafter, the operator chucks the lens LE replaced with the small diameter cup 640 by the lens chuck axes 102L and 102R and depresses the start switch of the switch unit 7 to actuate the apparatus.

When a processing start signal is inputted again after the roughing is completed, the control unit 50 actuates the lens shape measuring portions 300F, 300R to measure the edge positions on the front surface and rear surface of the lens based on the target lens shape data (target lens shape 800 in FIG. 7A). In the case of the flat processing mode, the target lens shape data are converted into the finishing path data. In the case of the bevel processing mode, the bevel path data formed on the lens LE based on the target lens shape data and the edge position information are computed as the finishing path. Further, if the chamfering is set, the chamfering path is computed based on the edge position data of the front surface and rear surface of the lens.

Figure 8:
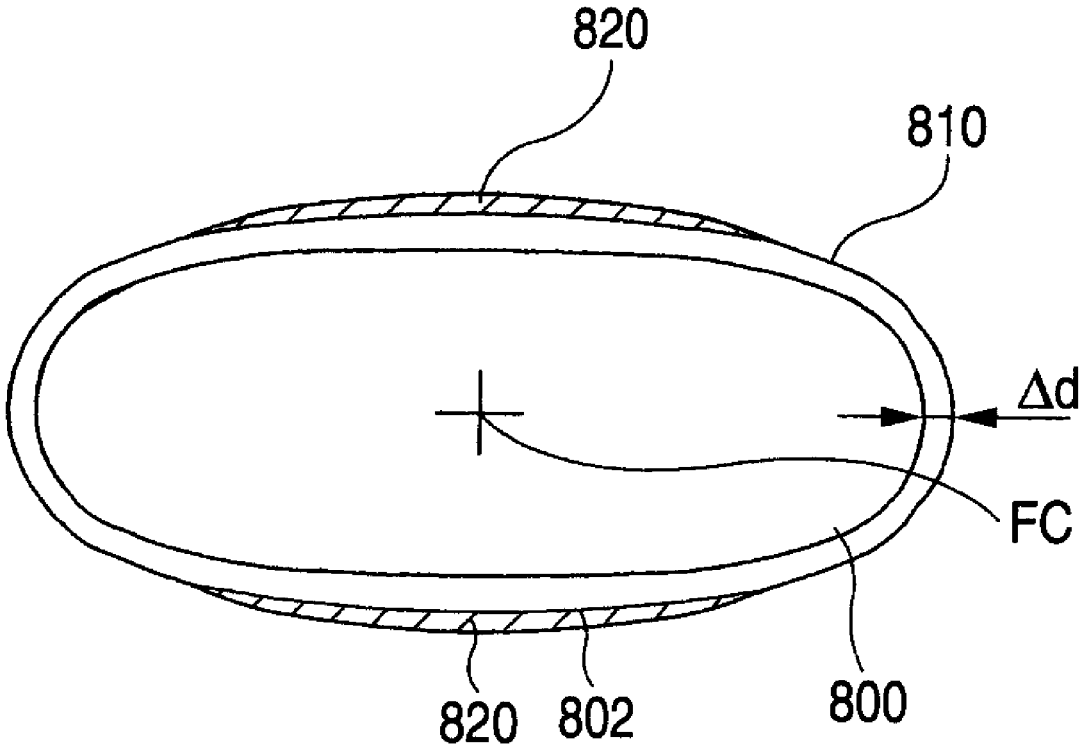
FIG. 8 is a view for explaining finishing.

When the finishing path has been acquired, the control unit 50 finishes the peripheral edge of the lens replaced with the small diameter cup 640 based on the finishing path. In this case, there are two finishing methods. In the first method, as shown in FIG. 8, after the remaining region 820 outside the path 802 increased from the target lens shape 800 by a finishing margin Δd (region when the first path 802 is subtracted from the roughing path 810) is roughed using the roughing grindstone 162*a*, the remaining finishing margin is processed using the finishing grindstone 162*b*. The control unit 50 controls the movement of the carriage 101 and the rotation of the lens LE based on the path 802 thereby to process the remaining region 820 using the roughing grindstone 162*a* again. In this case, although the small diameter cup 640 with a small attaching area has been attached to the lens LE, the remaining region 820 is sufficiently short in the distance from the cup center (lens rotation center) FC and the rotation moment load applied to the lens during the processing is small. Thus, even in the roughing by the roughing grindstone 162*a*, occurrence of the axis deviation will be suppressed. After the processing of the region 820 has been completed, successively, the control unit 50 controls the movement of the carriage 101 and the rotation of the lens LE based on the finishing path data obtained from the target lens shape data and others thereby to finish the peripheral edge of the lens LE using the finishing grindstone 162*b*.

In the second processing method, the entire region inclusive of the remaining region 820 is processed using the finishing grindstone 162*b*. The control unit 50 controls the movement of the carriage 101 and the rotation of the lens LE based on the finishing path data thereby to finish the peripheral edge of the lens LE using the finishing grindstone 162*b*. In the finishing, by detecting current of the grinding stone rotating motor 160, in this case, as compared with the first method, the region 820 is processed excessively using the finishing grindstone 162*b* so that the number of revolutions of the lens LE increases and so the processing time slightly increases. However, where the region 820 is relatively small, the processing time is not so greatly different from the total of the roughing time and finishing time in the first method.

Incidentally, according to the processing degree of the region 820, the first method and the second method can be selectively adopted. The processing degree of the region 820 can be schematically computed based on the region when the path 802 is subtracted from the path 810 and the lens thickness acquired from the measurement result of the edge positions of the front surface and rear surface of the lens.

Figure 9A:
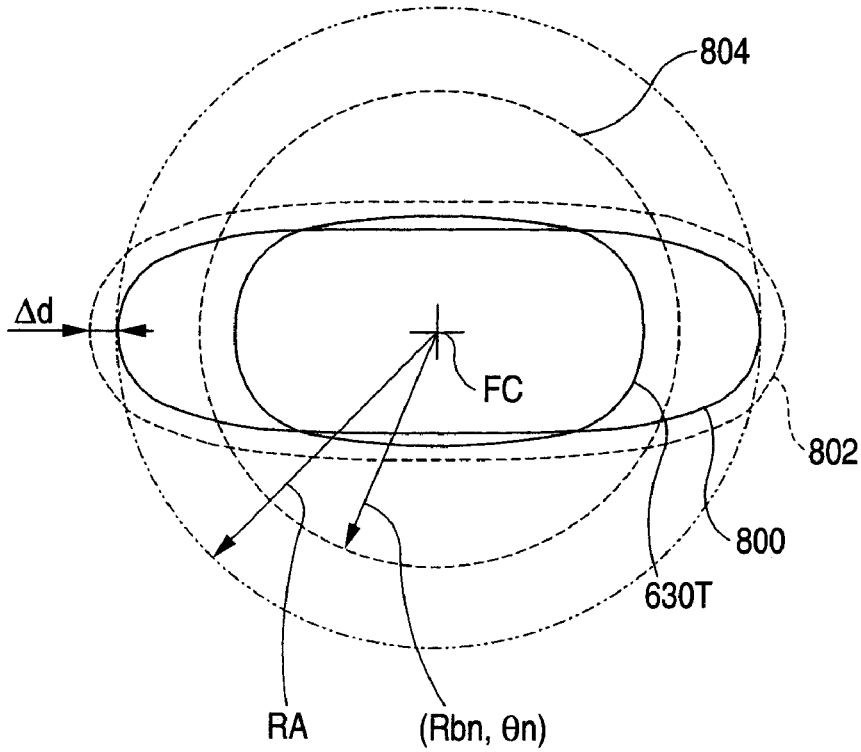
FIGS. 9A to 9B are views for explaining another example of calculation of roughing path data.
Figure 9B:
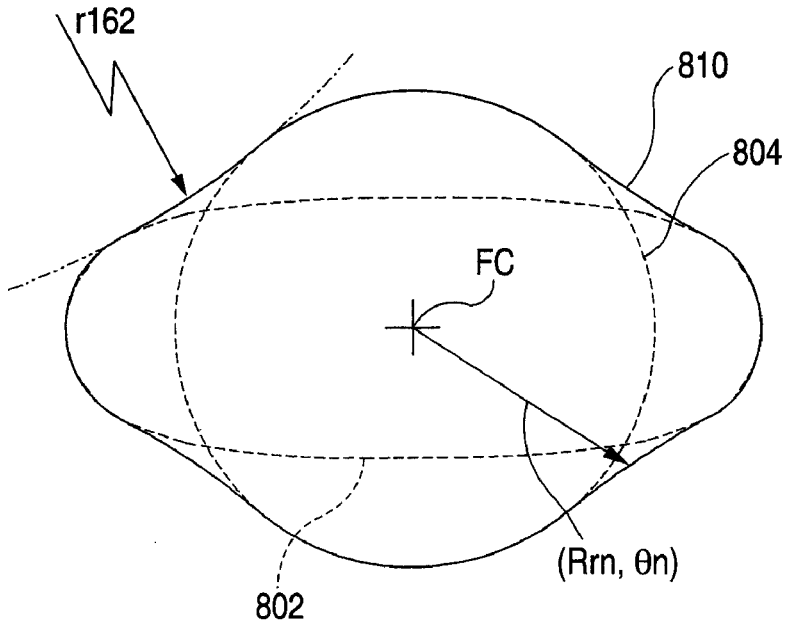

Additionally, the above method for computing the roughing path data is preferable to reduce the remaining shape to the utmost by the initial roughing. The method for computing the roughing data is not limited to such a method. For example, as shown in FIG. 9A, the radius vector length Rbn (n=1, 2, . . . , N) of the second path 804 may be set at a radius larger than the radius vector length Trn of the outer diameter 630T of the large diameter cup 630 from the attaching center position FC of the cup for the target lens shape 800 and within the range of the distance RA which prevents the axis deviation from occurring also in the roughing or finishing when the cup 630 is replaced by the small diameter cup 640. Where the small diameter cup 640 having a short axis Sd642 of 15 mm or less (13.5 mm in this embodiment) is employed, if the distance RA is 25 mm or less, the rotation moment load applied to the lens LE during the processing of the lens peripheral edge is small so that the axis deviation can be suppressed. Incidentally, it has been explained that the distance RA is 25 mm at the maximum. However, if the degree of allowing the axis deviation may be increased, the distance RA may be increased. The second path 804 may be any shape such as an ellipse. In the example of FIG. 9A, the radius vector length Rbn of the second path 804 is not longer than the distance RA and longer than the maximum radius of 15 mm of the large diameter cup 630. The radius vector length Rbn in FIG. 9A is set at a constant distance of 16 mm around the center FC. As shown in FIG. 9B, the roughing path 810 is computed as a path 810 of the radius vector (Rrn, θn) (n=1, 2, . . . , N) drawn so that the roughing grindstone 162 having a radius of r162 is in contact with the outermost path composed of the first path 802 and the second path 804.

The above description has been given of the example of using the double structure consisting of the small diameter cup 640 and the supporter 650. However, the cup to be employed should not be limited to such a cup. For example, the roughing may be carried out using the integral type cup 730 in place of the cup 630, and after the integral type cup 730 is removed from the lens LE, the small diameter cup 640 may be fixed again using the blocker. However, in this case, since the cup is twice fixed to the lens LE, accuracy of the attaching position deteriorates and labor of the operator increases. In contrast, if the cup 630 with the double structure as shown in FIGS. 5A to 5C is employed, labor of blocking the small diameter cup 640 using the blocker can be omitted, thereby suppressing occurrence of an error of the attaching position due to the repeated blocking. Thus, the processing of the lens peripheral edge with high accuracy can be realized.

Figure 10:
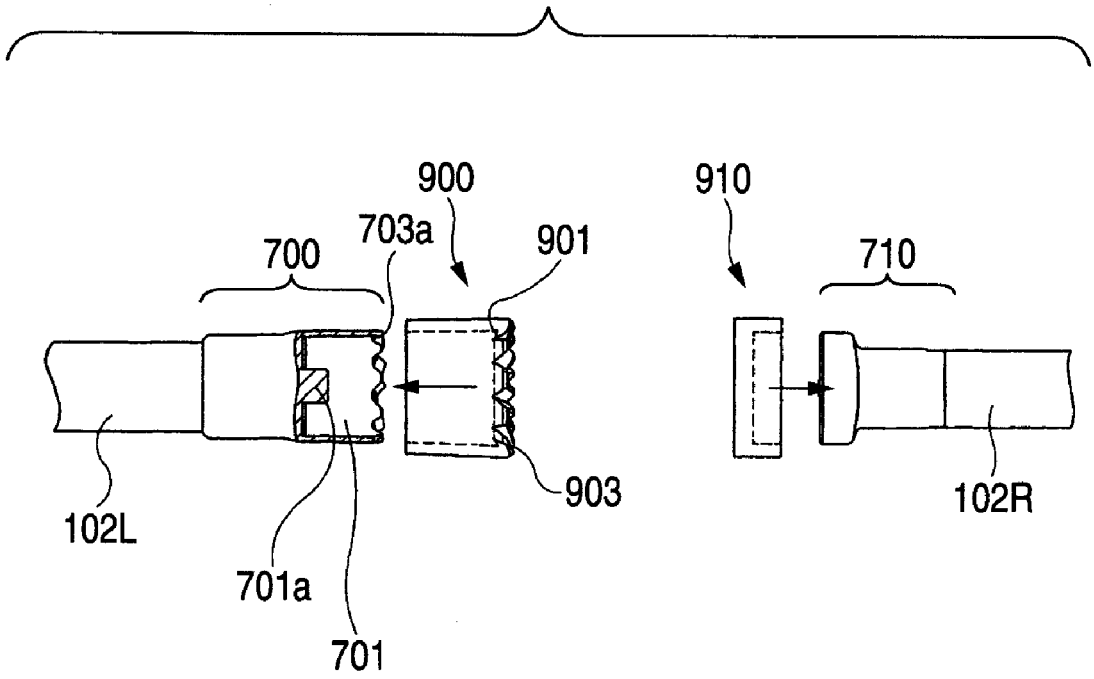
FIG. 10 is a view for explaining a modification of the cup holder and lens presser.

Further, in this embodiment, the cup holder 600 and lens presser 610 for the cup 630 was replaced by the cup holder 700 and lens presser 710 for the smaller cup 640. A modification of such a manner will be explained referring to FIG. 10.

Where the cup 630 is employed, a cup holder supporter 900 having a diameter corresponding to the cup 630 is mounted in a base of the cup holder 700 for the small diameter cup 640. The supporter 900 has a cylindrical structure within which an uneven area 901 to be fit to the uneven area 703*a* formed at the tip of the cup holder 700 is provided. Thus, after the supporter 900 is mounted over the cup holder 700, deviation of the cup holder 700 and supporter 900 from each other can be reduced. The uneven area 656*a* of the flange 656 of the cup 630 is fit to an uneven area 903 formed at the tip of the supporter 900. Thus, the supporter 900 mounted over the cup holder 700 can fulfill the same function as that of the cup holder 600.

Further, likewise, by mounting a lens presser supporter 910 having nearly the same peripheral shape as the supporter 900 over the lens presser 710, the supporter 910 can fulfill the same function as the lens presser 610.

In this way, by using the cup holder supporter 900 and the lens presser supporter 910, the labor of replacement between the cup holders 600 and 700 and the lens pressers 610 and 710 can be alleviated.

The explanation has been hitherto given of suppressing the axis deviation in the lens processing by using the grindstone 162 serving as a processing tool. However, the scope of applying the cup changing processing mode should not be limited to the above embodiments. For example, the cup changing processing mode can be applied to the case where an end mill is adopted as the processing tool (for example, US-2006-0240747-A1 (JP-A-2006-281367) because the axis deviation is worried about in this case also.

What is claimed is:

1. An eyeglass lens processing apparatus for processing a peripheral edge of an eyeglass lens based on target lens shape data, comprising:

a mode setting unit which shifts a processing mode to a two-step processing mode in which a cup for attaching the lens to a chuck axis is changed from a large diameter cup to a small diameter cup on the way of processing;

a roughing path data computing unit for computing first roughing path data larger than the target lens shape data by a predetermined finishing margin, and second roughing path data having a radius vector larger by at least Δa than at least radius vector data of the large diameter cup based on the first roughing path data and the radius vector data of the large diameter cup, Δa being a length set to avoid processing interference between a roughing tool and the large diameter cup; and a processing controller for roughing the peripheral edge of the lens attached to the large diameter cup based on the second roughing path data in response to a processing start signal, thereafter stopping the processing and further resuming the processing, wherein the processing controller performs, when a processing resuming signal is inputted, processing control of either finishing the peripheral edge using a finishing tool after roughing the peripheral edge of the lens replaced with the small diameter cup based on the first roughing path data using the roughing tool, or finishing the peripheral edge based on finishing path data using the finishing tool without roughing.

2. The eyeglass lens processing apparatus according to claim 1, wherein the second roughing path data are corrected composition path data in which the first roughing path and the path of the radius vector data of the large diameter cup added with Δa are composed to provide an outermost composition path and an area where the first roughing path and the path of the radius vector data of the large diameter cup added with Δa intersect is further corrected to avoid the processing interference during the processing.

3. The eyeglass lens processing apparatus according to claim 1, wherein the radius vector of the second roughing path data do not exceed a maximum distance determined based on rotation moment load applied to the lens during the processing with the small diameter cup.

4. The eyeglass lens processing apparatus according to claim 1, wherein the second roughing path data are corrected composition path data in which the first roughing path and the path of the radius vector data of the large diameter cup added with Δa are composed in a shape not exceeding a maximum distance determined based on rotation moment load applied to the lens during the processing with the small diameter cup to provide an outermost composition path and an area where the first roughing path and the path of the radius vector data of the large diameter cup added with Δa intersect is corrected to avoid the processing interference during the processing.

5. The eyeglass lens processing apparatus according to claim 4, wherein the maximum distance is 25 mm.

6. The eyeglass lens processing apparatus according to claim 1 further comprising:

a determining unit for comparing stored radius vector data of the large diameter cup and simulated radius vector data after finishing to determine whether or not the processing interference occurs; and a display unit for displaying the determined result when the processing interference occurs.

7. The eyeglass lens processing apparatus according to claim 1 further comprising a cup holder supporter corresponding to the size of the large diameter cup, the cup holder supporter being fit to a cup holder of the chuck axis and detachable therefrom.

8. The eyeglass lens processing apparatus according to claim 1 further comprising a lens presser supporter corresponding to the size of the large diameter cup, the lens presser supporter being fit to a lens presser of the chuck axis and detachable therefrom.

9. The eyeglass lens processing apparatus according to claim 1, wherein the cup includes:

a small diameter cup including a base mounted in a cup holder of the chuck axis and a small diameter flange attached to the base, one surface of the flange to be in contact with a surface of the lens through an adhesive material; and a supporter having an opening for inserting and removing the base of the small diameter cup, and including a surface to be in contact with the surface of the lens through an adhesive material having a larger diameter than that of the flange of the small diameter cup and a surface to be fit to the base side of the flange of the small diameter cup.

10. The eyeglass lens processing apparatus according to claim 9, wherein the adhesive material is a double-faced tape having a cut separatable at a boundary between the flange of the small diameter cup and the supporter.

11. The eyeglass lens processing apparatus according to claim 9, wherein the supporter is provided with hooks for removing the supporter from the small diameter cup.

* * * * *